United States Patent [19]

Kandathil

[11] Patent Number: 4,970,008

[45] Date of Patent: Nov. 13, 1990

[54] FABRIC CONDITIONER COMPRISING A MIXTURE OF QUATERNARY AMMONIUM COMPOUNDS AND SELECT TERTIARY AMINES

[76] Inventor: Thomas V. Kandathil, 5620 College Point Ct., Racine, Wis. 53402

[21] Appl. No.: 449,484

[22] Filed: Dec. 11, 1989

Related U.S. Application Data

[63] Continuation of Ser. No. 287,683, Dec. 20, 1988, abandoned, which is a continuation of Ser. No. 128,762, Dec. 14, 1987, abandoned.

[51] Int. Cl.[5] ..... D06M 11/00

[52] U.S. Cl. ..... 252/88; 252/542; 252/547

[58] Field of Search ..... 252/8.8, 547, 542

[56] References Cited

U.S. PATENT DOCUMENTS

| | | | |
|---|---|---|---|
| 3,034,911 | 5/1962 | McKee et al. | 106/210 |
| 3,186,869 | 6/1965 | Friedman | 117/138.8 |
| 3,322,674 | 5/1967 | Friedman | 252/90 |
| 3,349,033 | 10/1967 | Zuccarelli | 252/8.75 |
| 3,351,483 | 11/1967 | Miner et al. | 117/66 |
| 3,360,470 | 12/1967 | Wixon | 252/99 |
| 3,383,236 | 5/1968 | Brindamour | 117/100 |
| 3,554,784 | 1/1971 | Lyness | 117/47 |
| 3,576,760 | 4/1971 | Gould et al. | 252/403 |
| 3,594,212 | 7/1971 | Ditsch | 117/62 |
| 3,660,286 | 5/1972 | Sepulveda | 252/8.8 |
| 3,681,248 | 8/1972 | Gould et al. | 252/89 |
| 3,686,025 | 8/1972 | Morton | 117/140 R |
| 3,749,691 | 7/1973 | Kandathil | 260/29.6 XA |
| 3,822,145 | 7/1974 | Liebowitz et al. | 117/139.5 |
| 3,892,669 | 7/1975 | Rapisarda et al. | 252/8.75 |
| 3,896,033 | 7/1975 | Grimm | 252/8.8 |
| 3,915,867 | 10/1975 | Kang et al. | 252/8.8 |
| 3,915,882 | 10/1975 | Nirschl et al. | 252/131 |
| 3,947,971 | 4/1976 | Bauer | 34/60 |
| 3,974,076 | 8/1976 | Wiersema et al. | 252/8.8 |
| 3,977,980 | 8/1976 | Fry et al. | 252/8.8 |
| 4,018,688 | 4/1977 | Pracht et al. | 252/8.6 |
| 4,026,131 | 5/1977 | Dugger | 68/17 A |
| 4,035,307 | 7/1977 | Fry et al. | 252/8.6 |
| 4,041,205 | 8/1977 | Compa et al. | 428/220 |
| 4,073,735 | 2/1978 | Ramachandran | 252/8.8 |
| 4,073,996 | 2/1978 | Bedenk et al. | 428/274 |
| 4,077,890 | 3/1978 | Barker | 252/8.8 |
| 4,082,678 | 4/1978 | Pracht et al. | 252/8.6 |
| 4,108,600 | 8/1978 | Wong | 8/137 |
| 4,110,498 | 8/1978 | Benjamin | 428/35 |
| 4,115,292 | 9/1978 | Richardson et al. | 252/90 |
| 4,118,327 | 10/1978 | Seugnet | 252/8.8 |
| 4,124,116 | 11/1978 | McCabe | 206/204 |
| 4,156,592 | 5/1979 | Wood | 8/137 |
| 4,203,851 | 5/1980 | Ramachandran | 252/8.6 |
| 4,223,029 | 9/1980 | Mahler et al. | 427/242 |
| 4,234,442 | 11/1980 | Cornelissens | 252/90 |
| 4,234,627 | 11/1980 | Schilling | 427/242 |
| 4,242,377 | 12/1980 | Roberts et al. | 427/242 |
| 4,259,373 | 3/1981 | Demessemaekers | 427/242 |
| 4,260,054 | 4/1981 | Bory et al. | 206/0.5 |
| 4,292,035 | 9/1981 | Battrell | 8/137 |
| 4,304,562 | 12/1981 | Bolan et al. | 8/137 |
| 4,308,024 | 12/1981 | Wells | 8/137 |
| 4,328,110 | 5/1982 | Green | 252/8.75 |
| 4,356,099 | 10/1982 | Davies | 252/90 |
| 4,360,437 | 11/1982 | Wolfes | 252/8.8 |
| 4,395,342 | 7/1983 | Strauss | 252/8.75 |
| 4,410,441 | 10/1983 | Davies | 206/0.5 |
| 4,422,949 | 12/1983 | Ooms | 252/8.8 |
| 4,439,335 | 3/1984 | Burns | 252/8.75 |
| 4,540,499 | 9/1985 | Sakatani et al. | 252/8.75 |
| 4,555,349 | 11/1985 | Butterworth | 252/8.6 |
| 4,557,852 | 12/1985 | Schulz | 252/95 |
| 4,659,565 | 4/1987 | Smith | 424/70 |
| 4,661,269 | 4/1987 | Trink | 252/8.8 |
| 4,851,139 | 7/1989 | Lewis | 252/8.8 |

FOREIGN PATENT DOCUMENTS

| | | |
|---|---|---|
| 0040931 | 12/1981 | European Pat. Off. . |
| 0267662 | 5/1988 | European Pat. Off. . |
| 2000177 | 1/1979 | United Kingdom . |

OTHER PUBLICATIONS

Rosen, *Surfactants and Interfacial Phenomena,* p. 23 (1978).

*Primary Examiner*—John F. Niebling
*Assistant Examiner*—Isabelle R. McAndrews

[57] ABSTRACT

A fabric conditioner, available in solid or liquid form, comprising in combination a quaternary ammonium compound having at least one higher alkyl chain containing from 8 to 26 carbon atoms and a tertiary amine oxide having two identical higher alkyl chains, each having at least 8 carbon atoms and no more than 18 carbon atoms. The select amine oxides provide improved substantivity, antistatic properties, and water dispersibility to the fabric conditioner as well as providing improved softening characteristics.

10 Claims, No Drawings

FABRIC CONDITIONER COMPRISING A MIXTURE OF QUATERNARY AMMONIUM COMPOUNDS AND SELECT TERTIARY AMINES

This is a continuation of co-pending application Ser. No. 07/287,683 filed on Dec. 20, 1988, which is a continuation of Ser. No. 128,762, filed Dec. 14, 1987, both abandoned.

FIELD OF INVENTION

This invention is directed to fabric conditioners. More particularly, it is directed to improved fabric conditioners, available in solid or liquid form, comprising a quaternary ammonium cationic surfactant and a tertiary amine oxide with at least a major part of the amine oxide having at least two identical alkyl chains with from $C_8$ to $C_{18}$ carbon atoms in each chain.

BACKGROUND OF INVENTION

There are a great many fabric conditioners available for use in a home laundry. Generally, the known fabric conditioning agents can be grouped into the following classes which contain compounds having at least one long chain group:

(1) Cationic quaternary ammonium salts;
(2) Nonionic compounds, such as tertiary amine oxides;
(3) Anionic soaps, sulfates, and sulfonates;
(4) Zwitterionic quaternary ammonium compounds;
(5) Ampholytic tertiary ammonium compounds; and
(6) Compatible mixtures of one or more compounds of these classes.

More specifically, with respect to the use of amine oxides in fabric conditioners, U.S. Pat. No. 3,660,286 discloses a fabric softening composition comprising a mixture of a quaternary ammonium compound and an amine oxide. The quaternary ammonium compound has branched and straight chain higher alkyl groups in combination with lower alkyl groups. The amine oxide has one alkyl radical having from about 16 to 22 carbon atoms or the 2-hydroxy derivative thereof along with lower alkyl radicals. The combination of materials are said to provide fabric softening compositions which are useful in the liquid or solid state.

U.S. Pat. No. 3,892,669 discloses a clear homogeneous liquid aqueous fabric softener composition containing solubilized tetraalkyl quaternary ammonium salts having two short chain alkyl groups and two long chain alkyl groups together with solubilizers which can be anionic, nonionic, or amphoteric surfactants. The examples of the nonionic surfactants include tertiary amine oxides having one alkyl group ranging from $C_8$ to $C_{16}$ or the hydroxy-substituted alkyl groups.

U.S. Pat. No. 3,554,784 discloses fabric softeners in aqueous solution containing up to about 2 percent of a trialkylamine oxide with one of the alkyl groups having from 20 to 30 carbon atoms, a second alkyl group having from 1 to 20 carbon atoms, and wherein the third alkyl group contains from 1 to 3 carbon atoms. The preferred softening agents are trialkylamine oxides wherein one alkyl group contains from 20 to 26 carbon atoms, and the remaining two alkyl groups contain from 1 to 3 carbon atoms. All of the specific alkylamine oxides disclosed are the trialkylamine oxides wherein two of the alkyl groups are lower alkyl, and the remaining alkyl group is a higher alkyl having at least 20 carbon atoms.

U.S. Pat. No. 3,822,145 discloses fabric softeners comprising poly-lower alkylenes such as polyethylene. It is indicated that the fabric softeners can include amine oxides which are higher alkyl, di-lower alkyl amine oxides wherein the higher alkyl contains from 8 to 20 carbon atoms, preferably from 12 to 18 carbon atoms; and the lower di-alkyl group contains from 1 to 4 carbon atoms, preferably methyl.

U.S. Pat. No. 4,156,592 discloses an open-celled reticulated polyurethane foam compressed to form a sheet or wafer containing a fabric softener. The fabric softeners can include a tertiary amine oxide.

U.S. Pat. No. 4,242,377 discloses fabric conditioners wherein the fabric conditioner can include higher alkyl di-lower alkyl amine oxides wherein the higher alkyl contains from 8 to 20 carbon atoms and the lower alkyl contains from 1 to 4 carbon atoms, with the lower alkyls preferably being methyl.

None of the aforesaid patents discloses examples of fabric conditioners which utilize tertiary amine oxides having more than one higher alkyl chain, and the patents do not suggest that amine oxides having two higher alkyl chains will provide a beneficial result.

It is generally known in the art that fabric conditioners must impart softness, determined by the feel, to the conditioned fabric and, additionally, must have substantivity which means that something is there whether it feels good or not. Additionally, the fabric conditioner must have good dispersibility in water and impart antistatic characteristics to the conditioned fabrics. It is also recognized in the art that in formulating a fabric conditioner there is a degree of tradeoff in obtaining all of the aforesaid characteristics. Thus, it is known that if the carbon content of fabric conditioning components is increased from about $C_{16}$ to $C_{22}$, the softness imparted by the composition is increased. However, increasing the carbon content from 18 to 22 carbon atoms in an alkyl chain, while increasing the softness, decreases the water-dispersibility of the product and increases the water-repellency, leading to a waxy feel of the treated fabrics. Further, it is known that the $C_{18}$–$C_{22}$ alkyl chains have a tendency to lower the substantivity of the composition. Although the substantivity can be enhanced in certain compositions by including a material having from $C_{10}$ to $C_{14}$ carbon atoms in the alkyl chain, the lower carbon content materials will detract from softness. Accordingly, in spite of the recognized characteristics of fabric conditioners, it is still difficult to provide a composition having all of the desired characteristics.

OBJECTS AND SUMMARY OF THE INVENTION

Accordingly, a primary object of the present invention is to provide a fabric conditioner which will provide to a conditioned fabric softness, good substantivity, good antistatic properties, and good dispersibility in water.

It is another primary object of the invention to provide a fabric conditioner comprising a mixture of quaternary ammonium compounds and a tertiary amine oxide having two identical alkyl chains containing from 8 to 18 carbon atoms which can be made available in either solid or liquid form.

The aforesaid and other objects of the present invention will become apparent from the following general description and preferred embodiments.

The present invention is directed to fabric conditioners, available in either solid or liquid form, for treating fabrics which have controlled softness, antistatic properties, substantivity, and dispersibility. The fabric conditioners of the invention comprise a mixture of quaternary ammonium compound having branched and straight chain higher alkyl groups ranging from $C_8$ to $C_{26}$, and a tertiary amine oxide wherein two of the alkyl groups have a chain length of at least 8 carbon atoms and no more than 18 carbon atoms. Preferred dialkyl amine oxides are dioctyl amine oxide, dinonyl amine oxide, didecyl amine oxide, didodecyl amine oxide, amine oxides can also be employed.

The fabric conditioner comprising the above combination of compounds provides for excellent fabric softening characteristics, substantivity, antistatic properties, and dispersibility of the components in water. The unique characteristics are dependent on the utilization of the dihigher alkyl amine oxides.

GENERAL DESCRIPTION OF THE INVENTION

In the fabric conditioners of this invention which utilize a mixture of tertiary amine oxides and quaternary ammonium compounds, the quaternary ammonium compound is a compound having branched and straight chain higher alkyl groups represented by the following general formulas:

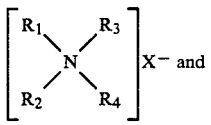

(I)

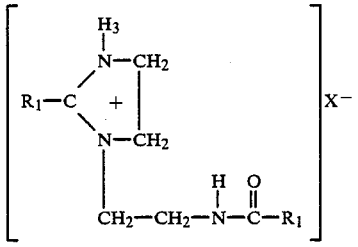

(II)

wherein at least one of $R_1$ and $R_2$ will have a chain length of from $C_8$ through $C_{26}$ with at least 50% of the $R_1$ and $R_2$ groups having at least 18 carbon atoms and at least 65% being below 22 carbon atoms. Preferred compounds utilized are those having a combination of $C_{18}$ and $C_{22}$ carbon atoms. These higher alkyl chains can be ethoxylated or propyloxylated. In the above formula $R_3$ and $R_4$ are each $C_1$–$C_4$ lower alkyl groups and preferably are independently selected from the group consisting of methyl, ethyl, propyl, isopropyl, and butyl radicals, and X is an anion selected from the group consisting of chloride, bromide, iodide, sulfate, methosulfate and ethosulfate, which imparts water dispersibility to the quaternary compound.

Generally, as the carbon content of $R_1$ and $R_2$ increases from $C_{16}$ to $C_{26}$, the fabric conditioning composition will have an increased softness. However, as is known, as the carbon content becomes greater, the compound becomes more waxy, with decreased dispersibility in water. Further, it is recognized that compounds having from $C_8$ to $C_{14}$ carbon atoms can provide improved substantivity to the fabric conditioner. It has been determined, however, that a mixture of the $C_8$–$C_{14}$ compounds with $C_{18}$ to $C_{22}$ compounds does not provide a conditioner with both good softness and substantivity. Rather, the conditioner has both decreased softness and a loss of substantivity.

It has been found according to the present invention that by utilizing the quaternary ammonium compounds wherein at least 50% of the higher alkyl chains contain at least 18 carbon atoms and with at least 65% of the higher alkyl chains being below 22 carbon atoms, in combination with tertiary amine oxides having two identical alkyl chains with from $C_8$–$C_{18}$ carbon atoms, it is possible to control the dispersibility of the composition while obtaining improved substantivity, antistatic properties, and softness.

The tertiary amine oxide compounds useful in this invention must have two alkyl chains having at least 8 carbon atoms and no more than 18 carbon atoms, and have the formula

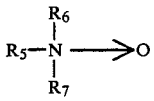

wherein $R_5$ and $R_6$ are straight and branched chain alkyl radicals having from 8 to 18 carbon atoms, and $R_7$ is a lower alkyl group having from 1 to 4 carbon atoms, and preferably is methyl. The preferred amine oxides are, in order, didecyl amine oxide, dinonyl amine oxide, dioctyl amine oxide, didodecyl amine oxide. These materials provide in combination with the quaternary ammonium compounds good dispersibility to the composition even at high carbon group content, i.e., 18 carbon atoms up to 26 carbon atoms, as well as providing good substantivity, antistatic properties, and softness.

Although it is possible to utilize the above-defined quaternary ammonium compounds and amine oxides to provide the enhanced characteristics, it has been found that optimum results are obtained when a mixture of $C_{18}$ and $C_{22}$ alkyl chains in the quaternary ammonium compound are utilized with amine oxides having di-$C_8$ through di-$C_{12}$ alkyl chains. The softness and feel associated with $C_{18}$ to $C_{22}$ alkyl chains is obtained while having the dispersibility normally associated with $C_{16}$ alkyl chains. The substantivity and antistatic properties of the fabric softeners are excellent and of the degree normally obtained with $C_{10}$ to $C_{14}$ alkyl chains.

In addition to the quaternary ammonium compound and the tertiary amine oxide, the fabric conditioners can include the additives conventionally employed such as a salt for improved viscosity control, coloring and perfume for aesthetic purposes, surfactants, and rinsing aids. It has been further found that the compositions of this invention can be used as aqueous dispersions with good stability; or the composition once prepared can be spray dried to provide a powder so that the fabric conditioner can be utilized as a solid. Particularly when utilizing the fabric softener as a solid, it is possible to utilize a filler. It may also be desirable to utilize a pH-control agent and/or pH buffer. Thus, it has been found that the amine oxides having an alkaline pH, i.e., above about a pH of 8, the amine oxide provides an anion. At an acid pH, i.e., at a pH at about 4.5, the amine oxide provides a cation. These characteristics can be used to provide a tailored fabric conditioner.

According to the present invention, the fabric softener can have ingredients in the preferred and operable ranges as follows:

| Ingredients | Preferred Range Parts by Weight | Operable Range Parts by Weight |
|---|---|---|
| Quaternary Ammonium Compound $C_8$ to $C_{26}$ | 53.50 | 50–97.5 |
| Tertiary Amine Oxide | 11.46 | 2.5–50 |
| Surfactant | 0.19 | 0–20 |
| Perfume | 2.38 | 0–20 |
| pH-Control Agent | 0.90 | 0–4.5 |
| Salt | 1.48 | 0–7.4 |

The fabric conditioners of the present invention have been found to be particularly effective as the fabric conditioner in a fabric conditioning article such as described in my commonly assigned, concurrently filed application entitled "Wash-Added, Rinse-Activated Fabric Conditioner and Package", Ser. No. 07/129,130, filed Dec. 4, 1987, which is incorporated herein by reference. U.S. Pat. No. 4,795,032, which is the aforesaid fabric-conditioning article for use in a washing machine having a wash, spin, and rinse cycle comprises a fabric conditioner and a material that will swell upon the absorption of water in a package which will permit passage of water and has at least one area which will open upon application of internal pressure for releasably containing the fabric conditioner. In use, the package is tossed into a washing machine at the beginning of the wash cycle. The water-absorbing material within the package swells with absorbed water, creating an internal pressure within the package. Upon exposure to the centrifugal force of the spin cycle, the swollen package breaks open thereby releasing the conditioner into the water of the rinse cycle. When used in the aforesaid article, it is only necessary to add to the fabric-conditioner composition of the present invention a water-absorbing material such as a modified starch or a superabsorbent polyelectrolyte material of the type disclosed in my concurrently filed application.

PRESENTLY PREFERRED EMBODIMENTS

EXAMPLE 1

40 parts ditallow-dimethyl ammonium chloride, 20 parts dibehenyl dimethyl ammonium chloride, and 14 parts didecyl methylamine oxide were blended in a Waring blender in the presence of 25 parts Surfynol 104-H and 100 parts distilled water at a temperature of about 140°–200° F. Surfynol 104-H is a ditertiary acetylenic diol which acts as a surfactant. After the composition was blended, 2.6 parts perfume, 1.5 parts citric acid, and 2 parts sodium carbonate were added with additional blending. The liquid dispersion was stable for a period of several months. The liquid composition which was readily dispersible in water when used as a fabric softener in a conventional manner in the rinse cycle of a washing process provided excellent softness, substantivity, and antistatic characteristics.

EXAMPLE 2

A composition prepared as set forth in Example 1 was spray dried using a conventional spray dryer. The powder obtained when added to the rinse cycle of a washing operation was readily dispersible in water and provided softness, substantivity, and antistatic characteristics to the washed fabrics comparable to those obtained in Example 1.

EXAMPLE 3

Two sheets of long-fiber cellulosic papers having a web of Vinyon sold under the tradename "Berkshire Heat-Seal" paper by Kimberly-Clark were heat-sealed on two sides and one end. The package is approximately 3"×2". The package is filled with approximately 5 grams of a composition as follows:

| Component | Amount |
|---|---|
| Ditallow-dimethyl ammonium chloride | 38.21 g |
| Dibehenyl dimethyl ammonium chloride | 15.29 g |
| Didecyl methylamine oxide | 11.46 g |
| Starch/Modified Starch | 30.09 g |
| Surfynol 104-H (surfactant) | 0.19 g |
| Perfume | 2.38 g |
| Citric Acid | 0.90 g |
| Sodium Carbonate | 1.48 g |
| Total | 100.00 g |

After filling the package, the unsealed fill end was closed in a teabag-type closure wherein the ends were folded in and overlapped. The package was added to a top-loading Whirlpool washer along with turkish towels and a conventional laundry detergent. The washer was filled with water and passed through the regular operation of the washer. In observing the package during the wash cycle, it was seen that the package was agitated within the wash water along with the towels. The package would periodically surface to the top of the water. The package remained intact throughout the wash cycle but noticeably grew in size. After the wash water was drained, and the last traces of water removed in the spin cycle, the rinse water filled into the machine drum. Upon agitation it was seen that the package had opened at the one end. Over a period of approximately two minutes the contents of the package was dispersed into the rinse water. An examination of the package after the rinse cycle and spin dry cycle were completed showed that the package was completely empty and free of any fabric conditioner. The conditioned fabric was soft and free of static.

EXAMPLE 4

A non-woven polypropylene sheet was rolled into a tube and pressed so that the two ends of the tube met approximately at the center of one of the faces of the package. One end of the tube was heat-sealed. The center opening where the ends of the tube meet was sealed with an adhesive material to provide a weak seal. The package was filled with a composition as utilized in Example 3 except in this example the starch was replaced with a superabsorbent material sold under the tradename "Aquasorb" and marketed by Aqualon Company. After filling the package, the filling end of the package was heat-sealed. The package was utilized in a Whirlpool washer in the same manner as was the package in Example 3. The package opened along the center opening during the rinse cycle and dispersed the contents of the package into the rinse water. The fabrics which were treated were soft, sweet and fresh smelling, and free of static.

The fabric softeners utilized as described in Examples 1–4 did not in any way discolor the fabric.

As will be apparent to one skilled in the art, various modifications can be made within the scope of the aforesaid description. For example, the composition in addition to being used as a liquid dispersion or as a powder, can be used to impregnate a non-woven material and the impregnated non-woven material utilized in the dryer of a home laundry as are the commercially available products such as "Bounce." Further, color aids, whitening aids, and the like can be utilized. Such modifications being within the ability of one skilled in the art form a part of the present invention and are embraced by the appended claims.

It is claimed:

1. A fabric conditioner comprising in combination (A) a quaternary ammonium compound of the formulas (I)

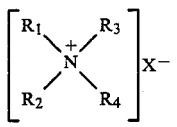

or (II)

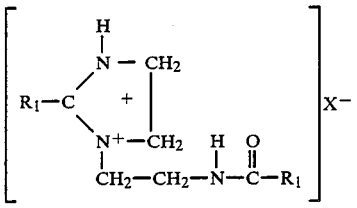

wherein at least one of $R_1$ and $R_2$ has a chain length of from $C_8$ through $C_{26}$ with at least 50% of $R_1$ and $R_2$ having 18 carbon atoms and at least 65% of $R_1$ and $R_2$ having a chain below 22 carbon atoms; $R_3$ and $R_4$ each being a lower alkyl group having from 1 to 4 carbon atoms and X is an anion; and (B) a tertiary amine oxide for dispersing said quaternary ammonium compound having two alkyl chains of identical lengths each having at least 8 carbon atoms and no more than 12 carbon atoms of the formula

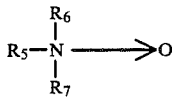

wherein $R_5$ and $R_6$ are each straight or branched chain alkyl radicals having from 8 to 12 carbon atoms, and $R_7$ is a lower alkyl group having 1 to 4 carbon atoms, said fabric conditioner is added during the rinse-cycle of an automatic washing machine.

2. The fabric conditioner of claim 1 wherein $R_1$ and $R_2$ are $C_{18}$ through $C_{22}$ and $R_5$ and $R_6$ are each $C_{10}$.

3. The fabric conditioner of claim 1 dispensed in water.

4. The fabric conditioner of claim 3 wherein component (A) is present at from 50 to 97.5 parts by weight, and component (B) is present at from 2.5 to 50 parts by weight dispensed in water.

5. The fabric conditioner of claim 1 in power form.

6. The fabric conditioner of claim 5 wherein component (A) is present at from 50 to 97.5 parts by weight, and component (B) is present at from 2.5 to 50 parts by weight.

7. The fabric conditioner of claim 4 including from 0 to 20% perfume, 0 to 1.0% coloring aid, and 0 to 20% surfactant.

8. The fabric conditioner of claim 6 including from 0 to 20% perfume, 0 to 1.0% coloring aid, and 0 to 20% surfactant.

9. The fabric conditioner of claim 8 containing from 1 to 70% water-absorbable material.

10. The fabric conditioner of claim 1 wherein $R_1$ is $C_{18}$, $R_2$ is $C_{22}$, and $R_5$ and $R_6$ are each $C_8$.

* * * * *

UNITED STATES PATENT AND TRADEMARK OFFICE

CERTIFICATE OF CORRECTION

PATENT NO. : 4,970,008

DATED : November 13, 1990

INVENTOR(S) : Kandathil

It is certified that error appears in the above-identified patent and that said Letters Patent is hereby corrected as shown below:

In column 3, please make the following changes:
in line 14, after the words "didecyl amine oxide" insert the word -- and -- .
in line 14, after the words "didodecyl amine oxide" delete the comma "," and substitute therefor a period -- . -- .
At the beginning of line 15, insert the words -- Mixtures of the -- before the words "amine oxides."

UNITED STATES PATENT AND TRADEMARK OFFICE

CERTIFICATE OF CORRECTION

PATENT NO. : 4,970,008

DATED : November 13, 1990

INVENTOR(S) : Kandathil

It is certified that error appears in the above-identified patent and that said Letters Patent is hereby corrected as shown below:

In lines 40-46, please delete structural formula II and substitute therefor:

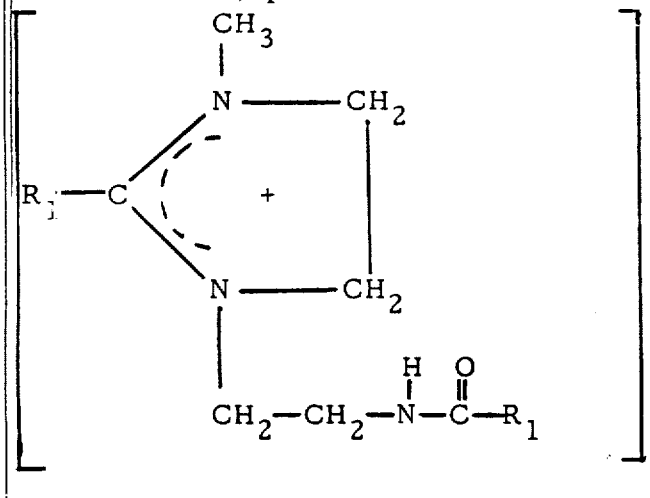

$X^-$ (II)

In the Claims

In claim 1, column 7, please delete the structural formula and substitute therefor the above formula. Formula II is identical for both the specifications and the claims; therefore, the above formula is an appropriate replacement to use in both areas.

Signed and Sealed this

Twelfth Day of May, 1992

*Attest:*

DOUGLAS B. COMER

*Attesting Officer*

*Acting Commissioner of Patents and Trademarks*